US006701735B1

(12) United States Patent
Daddis, Jr. et al.

(10) Patent No.: US 6,701,735 B1
(45) Date of Patent: Mar. 9, 2004

(54) MULTI DECK MERCHANDISER WITH HORIZONTAL AIR CURTAINS

(75) Inventors: Eugene Duane Daddis, Jr., Manlius, NY (US); Sue-li "Kingsley" Chuang, Glastonbury, CT (US)

(73) Assignee: Carrier Commercial Refrigeration, Inc., Syracuse, NY (US)

( * ) Notice: Subject to any disclaimer, the term of this patent is extended or adjusted under 35 U.S.C. 154(b) by 0 days.

(21) Appl. No.: 10/265,044

(22) Filed: Oct. 4, 2002

(51) Int. Cl.[7] ..... A47F 3/04
(52) U.S. Cl. ..... 62/255; 62/256; 454/193
(58) Field of Search ..... 62/255, 256; 454/193

(56) References Cited

U.S. PATENT DOCUMENTS 3,063,252 A * 11/1962 Lamb ..... 62/234
3,125,864 A * 3/1964 Ural ..... 62/256
3,229,475 A * 1/1966 Balk et al. ..... 62/256
3,232,072 A * 2/1966 Barroero ..... 62/256
5,357,767 A * 10/1994 Roberts ..... 62/256
5,875,642 A * 3/1999 Lee et al. ..... 62/256

* cited by examiner

*Primary Examiner*—William E. Tapolcai
(74) *Attorney, Agent, or Firm*—Carlson, Gaskey & Olds

(57) ABSTRACT

A refrigeration system comprises a display case defining a display space. A cooling element cools the display space. An air mover direct air across the cooling element. At least one air outlet guides cool air into the display space to an air inlet located at the end of the shelf.

23 Claims, 2 Drawing Sheets

MULTI DECK MERCHANDISER WITH HORIZONTAL AIR CURTAINS

BACKGROUND OF THE INVENTION

This invention relates to a refrigerated display case.

Refrigerated display cases found in supermarkets and convenience stores may have an open viewing area that permits consumers to reach into the display case without opening a door to retrieve refrigerated product from the display cases shelves. To keep the product refrigerated within the display case, these refrigerated merchandisers have an air curtain that extends from near the top to near the bottom of the display case over the viewing area. An outlet at the top of the display case blows air vertically down to a warm air return near the bottom of the display case. This air is drawn into the warm air return by a fan that then blows the warmed air over a refrigeration coil and recycles the air back to the air outlet at the top of the display case through a duct extending from the refrigeration coil to the air outlet.

Due to the relative locations of the air inlet and air outlet, the air curtain generally extends over the entire viewing area. The air curtain is consequently very large. Because of the size of the air curtain, it is more susceptible to the intrusion of ambient warm air from outside the display case. It thus takes a significant amount of energy to cool product within the display case. While display cases exist that direct air over the product from the back to the front of the display case (horizontally), air from these outlets continues to be returned to an air inlet at the bottom of the display case resulting in a longer than necessary air curtain.

A need therefore exists for an energy efficient display merchandiser that offers the benefits of an open viewing area without excessive energy consumption.

SUMMARY OF THE INVENTION

The inventive refrigeration system directs an air curtain over products on a shelf from an air outlet located near the back of the display case to an air inlet located at the front of the shelf rather than near the bottom of the display case. In this way, the display case limits the size of the air curtain to about the length of the shelf. By shortening the size of the air curtain, less energy is consumed resulting in more efficient refrigeration. Also, a horizontal air curtain is more effective as gravity will tend to hold the air curtain on the product in the display case.

Like other refrigerator display cases, the inventive display case has a display space. A cooling element, such as a refrigeration coil, cools air for the display case. This air is directed across the cooling element to an air outlet that guides the air directly into the display space. However, unlike existing display cases, the inventive display case has a shelf with an air inlet that serves to draw air from the air outlet so that air travels just about the length of the shelf instead over the entire viewing area.

The inventive system may have several shelves, each with their own air inlet. An air mover, such as a blower, may direct air to the multiple air outlets on one end of each shelf, which in turn direct air to an associated air inlet located on the other end of the shelf. The air outlet may guide the air across the length of each shelf and be place above the anticipated height of product on the shelves. Air from each air inlet may then be returned through the shelf to a cooling element and then recycled back to the air outlet.

The shelves may be wider on one end than the other. Moreover, one end of the shelves may be at a higher elevation than the other. The shelves may be placed at various elevations, including the bottom of the display case.

The shelves may have a duct to communicate air from the air inlet back to the cooling element. The shelves may themselves act like a duct. An additional duct may serve to channel air from the air inlet directly to the refrigeration coil. Also, each of the shelves may have their own coil and fan so that air may circulate around each shelf.

The invention limits the size of the air curtain and improves product refrigeration without significantly increasing costs. Moreover, the path of the air serves to expel warm air from the display space. Without significant expense, the inventive display case provides an energy efficient merchandiser to refrigerate product.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
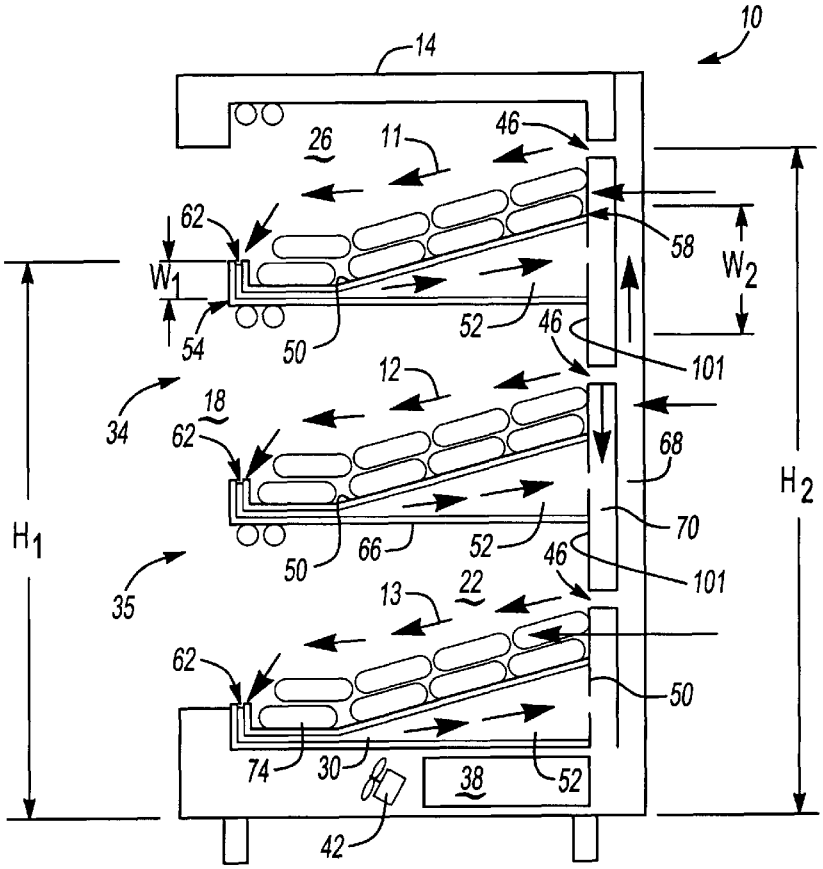
FIG. 1 illustrates a side view of the inventive refrigeration system, showing display case, air outlet, and air inlet.
Figure 2:
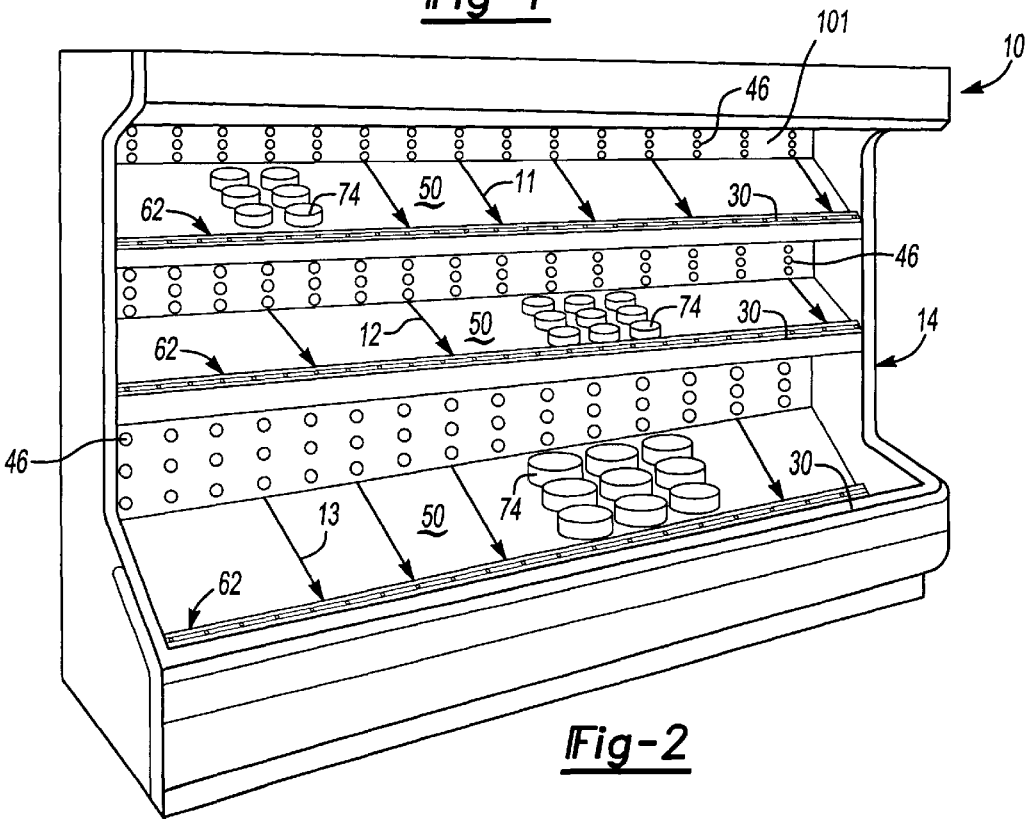
FIG. 2 illustrates a perspective view of the inventive refrigeration system.

As shown in FIG. 1, inventive refrigeration system 10 comprises display case 14 having front area 18, back area 22 defined by back wall 101, top area 26 and bottom area 30. Each of these areas helps to define display space 34 contained within display case 14. As shown, display case 14 has viewing area 35, an open area that permits consumers to reach into display case 14 to retrieve product 74 stored on shelves 50. FIG. 2 shows a perspective view of display case 14. These features of display case 14 are well known.

In contrast to existing display cases, refrigeration system 10 has air curtains 11, 12, 13 that extend generally horizontally (from back of display case to front) from air outlets 46 located on back wall 101 to air inlets 62 on shelves 50. As shown in FIGS. 1 and 2, rather than extend across viewing area 35, air curtains 11, 12, 13 may extend only over products 74 on shelves 50. The size and orientation of each of these individual air curtains 11, 12 and 13 is less than viewing area 35, resulting in less ambient air infiltration from outside display case 14. As detailed below, the size of each air curtain 11, 12, and 13 is limited by the novel location of air inlets 62 on shelves 50.

Air curtains 11, 12 and 13 are created by air mover 42, such as a blower, like a fan panel, or other air moving devices, that blows air out of air outlets 46 to air inlets 62. Air outlets 46 may direct air downward toward shelves 50 or simply to front area 18 from back area 22. Air inlets 62 on shelves 50 serve to draw air expelled from air outlets 46 via air mover 42, which uses air inlets 62 as a source for air for air outlets 46. Rather than place air inlets 62 at the bottom of display case as known, inventive refrigeration system 10 places air inlets 62 on shelves 50, thereby limiting the size of air curtains 11, 12 and 13 to the distance between air outlet 46 on one side of the shelf and air inlet 62 on the other. Thus, air travels from air outlet 46 from back area 22 of display case 14 to air inlet 62 on shelves 50 near front area 18 instead of to an air inlet located at the bottom of the display case. Moreover, air outlets 46 may be placed at a predetermined height above the expected height of product 70 so that air flows over product rather than through product 74.

As further shown in FIG. 1, shelves 50 have first portion 54 having width W1 and second portion 58 having width W2. Width W1 is less than width W2, resulting in angled shelves that permit air curtain 11, 12 and 13 to flow down product 74 from air outlet 46 to air inlet 62. Air inlet 62 is at height H1, which is at a lower height than air outlet 46, which is at height H2. This design takes advantage of the fact that cool air tends downward.

Once air has passed from air outlet 46 to air inlet 62, air then passes underneath shelves 50 through ducts 52 that may extend through shelves 50 to vertical return ducts 70. This air is then cycled back to cooling element 38, such as a refrigeration coil, via air mover 42, which draws the warmed air over cooling element 38 and then returns cooled air to air outlets 46 through supply duct 68. A worker in this art would understand that the FIG. 1 is a somewhat schematic view, and the blower, passages, parts, etc. may have a different arrangement.

As shown in FIG. 2, product 74 is insulated from ambient warm air by air curtains 11, 12 and 13 that extend from air outlets 46 to air inlets 62 on shelves 50. Air outlets 46 may direct air downward from back area 22 to front area 34 away from top area 26. In this way, each air curtain is smaller resulting in an energy efficient refrigeration system design. The positioning of air curtains in a more horizontal rather than vertical fashion further permits air curtains 11, 12 and 13 to take advantage of forces on the air curtain, such as buoyancy forces, that tend to pull the cold air curtain down. Moreover, the Coanda-effect, a viscous effect, acts to keep air curtains II, 12 and 13 on a continuous surface as provided by shelves 50. As a consequence of this horizontal orientation of air curtains 11, 12 and 13 cold air is kept on the product.

Figure 3:
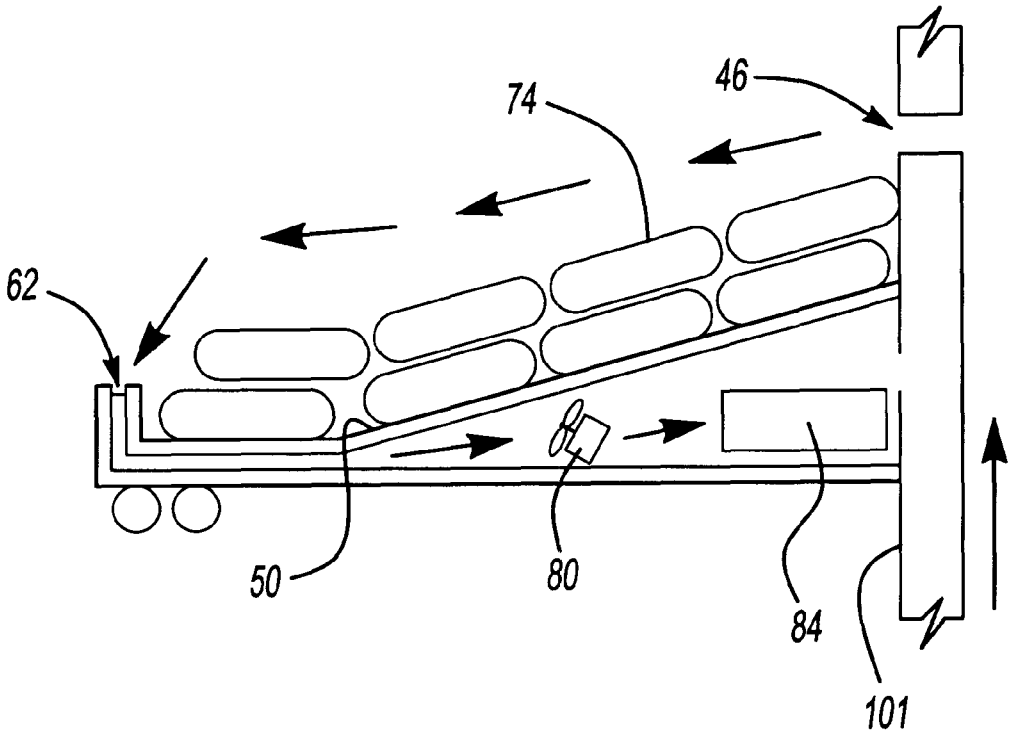
FIG. 3 illustrates a variation of the inventive refrigeration system.

FIG. 3 illustrates a variation of the inventive refrigeration system. Within shelf 50 are air mover 80, a fan, and cooling element 84, a refrigeration coil. Air mover 80 receives air through air inlet 62 and directs the air to cooling element 84, which cools the received air. The air is then cycled back over product 74 on shelf 50 through air outlet 46. Multiple shelves may be used, each with their own air mover 80 and cooling element 84.

The aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. A refrigeration system comprising:

a display case defining a display space, said display case having a front area and a back area;

a cooling element in communication with said display case for cooling said display space;

an air mover for directing air across said cooling element;

at least one air outlet in communication with said air mover for guiding air into said display space along a generally horizontal direction; and at least one shelf having at least one air inlet drawing air from said at least one air outlet.

2. The refrigeration system of claim 1 wherein said at least one air outlet guides air across said at least one shelf to said at least one air inlet.

3. The refrigeration system of claim 1 wherein said at least one shelf comprises a first portion narrower than a second portion.

4. The refrigeration system of claim 1 wherein said at least one shelf comprises a first portion and a second portion, said first portion at a lower elevation than said second portion.

5. The refrigeration system of claim 1 wherein said air mover comprises a blower.

6. The refrigeration system of claim 1 wherein said at least one shelf has a shelf duct communicating air from said at least one air inlet to said cooling element.

7. The refrigeration system of claim 6 wherein said at least one shelf comprises said shelf duct.

8. The refrigeration system of claim 6 wherein said shelf duct extends from said at least one shelf to a return duct extending along a back of said display case to said cooling element.

9. The refrigeration system of claim 1 wherein said at least one shelf comprises a bottom of said display space.

10. The refrigeration system of claim 1 including a wall defining said back area, said at least one air outlet located on said wall.

11. A refrigeration system comprising:

a display case defining a display space, said display case having a front area and a back area;

a cooling element in communication with said display case for cooling said display space;

an air mover for directing air across said cooling element;

a first air outlet in communication with said air mover for guiding air into said display space from said back area towards said front area;

a first shelf having a first air inlet drawing air from said first air outlet;

a second air outlet in communication with said air mover for guiding air into said display space from said back area towards said front area; and a second shelf having a second air inlet drawing air from said second air outlet.

12. The refrigeration system of claim 11 wherein at least one of said air outlets guides air generally horizontally across at least one of said shelves to at least one of said air inlets.

13. The refrigeration system of claim 11 wherein at least one of said shelves comprises a first portion wider than a second portion.

14. The refrigeration system of claim 11 wherein at least one of said shelves comprises a first portion and a second portion, said first portion at a lower elevation than said second portion.

15. The refrigeration system of claim 11 wherein at least one of said shelves comprises a shelf duct communicating air from at least one of said air inlets to said cooling element.

16. The refrigeration system of claim 15 wherein said shelf duct extends from at least one of said shelves to a return duct extending along a back of said display case to said cooling element.

17. The refrigeration system of claim 11 wherein at least one of said shelves comprises a bottom of said display space.

18. The refrigeration system of claim 11 wherein at least one of said air outlets is located above an anticipated height of a product to be placed on at least one of said shelves.

19. The refrigeration system of claim 11 wherein said air mover comprises a blower.

20. The refrigeration system of claim 19 wherein said blower comprises at least one fan.

21. A refrigeration system comprising:

a display case, defining a display space;

a cooling element in communication with said display case for cooling said display space;

an air mover for directing air across said cooling element;

at least an air outlet in communication with said air mover for guiding air into said display space; and at least one shelf having an air inlet in communication with said air mover wherein air communicates from said air outlet to said air inlet and through said at least one shelf to said cooling element, said air mover located in said at least one shelf.

22. The refrigeration system of claim 21 wherein said air mover comprises a blower.

23. The refrigeration system of claim 22 wherein said cooling element is located within said at least one shelf.

* * * * *